US009524672B2

(12) United States Patent
Sun et al.

(10) Patent No.: US 9,524,672 B2
(45) **Date of Patent: *Dec. 20, 2016**

(54) ORGANIC LIGHT EMITTING DIODE DISPLAY APPARATUS WITH POWER CIRCUIT TO ACCELERATE A VOLTAGE LEVEL

(71) Applicant: Chunghwa Picture Tubes, LTD., Taoyuan (TW)

(72) Inventors: Bo-Jhang Sun, Kaohsiung (TW); Chin-Hai Huang, Taoyuan County (TW); Szu-Chi Huang, Changhua County (TW)

(73) Assignee: Chunghwa Picture Tubes, LTD., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/945,404

(22) Filed: Nov. 18, 2015

(65) Prior Publication Data

US 2016/0071462 A1 Mar. 10, 2016

Related U.S. Application Data

(62) Division of application No. 13/706,362, filed on Dec. 6, 2012, now Pat. No. 9,262,960.

(30) Foreign Application Priority Data

Sep. 21, 2012 (TW) ..... 101134846 A

(51) Int. Cl.
*G09G 3/30* (2006.01)
*G09G 3/32* (2016.01)

(52) U.S. Cl.
CPC ..... *G09G 3/3258* (2013.01); *G09G 3/3208* (2013.01); *G09G 3/3233* (2013.01);
(Continued)

(58) Field of Classification Search
CPC ..... G09G 3/3233; G09G 2300/0842; G09G 2300/0861
(Continued)

(56) References Cited

U.S. PATENT DOCUMENTS 7,612,749 B2 * 11/2009 Libsch ..... G09G 3/3233 345/82
2004/0125094 A1 * 7/2004 Hudson ..... G09G 3/3648 345/204

(Continued)

*Primary Examiner* — Jonathan Blancha
(74) *Attorney, Agent, or Firm* — Jianq Chyun IP Office

(57) ABSTRACT

An organic light emitting diode (OLED) display apparatus includes a power circuit and a pixel. The power circuit serves to provide a first voltage. The pixel includes a first transistor, a second transistor, a third transistor, a fourth transistor, a fifth transistor, a capacitor, and an OLED. During a programming period, a first terminal of the capacitor receives a data voltage through the turned-on first transistor, a first terminal of the second transistor receives the first voltage, a control terminal of the second transistor is coupled to a second terminal of the capacitor and coupled to a second terminal of the second transistor through the turned-on third transistor, and the power circuit regulates a voltage level or a current of the first voltage to accelerate a voltage level of the control terminal of the second transistor to reach a target voltage.

8 Claims, 7 Drawing Sheets

(52) U.S. Cl.
CPC ..... *G09G 2300/0819* (2013.01); *G09G 2300/0842* (2013.01); *G09G 2300/0861* (2013.01); *G09G 2300/0871* (2013.01); *G09G 2310/0243* (2013.01); *G09G 2310/08* (2013.01); *G09G 2320/045* (2013.01); *G09G 2330/02* (2013.01); *G09G 2330/021* (2013.01); *G09G 2330/028* (2013.01)

(58) Field of Classification Search
USPC ..... 345/76
See application file for complete search history.

(56) References Cited

U.S. PATENT DOCUMENTS

| | | | | |
|---|---|---|---|---|
| 2007/0040772 | A1* | 2/2007 | Kim | G09G 3/3233 345/76 |
| 2011/0273109 | A1* | 11/2011 | Park | G09G 3/3225 315/291 |
| 2011/0292015 | A1* | 12/2011 | Komiya | G09G 3/003 345/211 |
| 2012/0105421 | A1* | 5/2012 | Tsai | G09G 3/3233 345/212 |

* cited by examiner

ORGANIC LIGHT EMITTING DIODE DISPLAY APPARATUS WITH POWER CIRCUIT TO ACCELERATE A VOLTAGE LEVEL

CROSS-REFERENCE TO RELATED APPLICATION

This application is a divisional application of U.S. application Ser. No. 13/706,362, filed on Dec. 6, 2012, now allowed. The prior U.S. application Ser. No. 13/706,362 claims the priority benefits of Taiwan application serial No. 101134846, filed on Sep. 21, 2012. The entirety of each of the above-mentioned patent applications is hereby incorporated by reference herein and made a part of this specification.

BACKGROUND OF THE INVENTION

Field of the Invention

The invention relates to a display apparatus. More particularly, the invention relates to an organic light emitting diode (OLED) display apparatus.

Description of Related Art

With the advance of science and technology, flat panel displays have drawn most attention in the field of displays recently. Among the flat panel displays, organic light emitting diode (OLED) displays characterized by self-luminescence, wide view angle, low power consumption, simple manufacturing process, low costs, low operational temperature range, high responsive speed, and full color have a great potential of becoming the next-generation mainstream flat panel displays.

To manage the brightness of the OLED, the OLED is often serially connected to a transistor. Through controlling the conducting state of the transistor, the current flowing through the OLED may be controlled, and thereby the brightness of the OLED may be further managed. Generally, during a period of programming a pixel, it is intended to equalize the voltage between a gate and a source of the transistor coupled to the OLED with a threshold voltage, so as to subsequently perform code compensation. Hence, how to equalize the voltage between the gate and the source of the transistor coupled to the OLED with the threshold voltage through circuitry design or through adjustment of driving ways has become one of the important topics in terms of driving the OLED.

SUMMARY OF THE INVENTION

The invention is directed to an organic light emitting diode (OLED) display apparatus with favorable display quality.

In an embodiment of the invention, an OLED display apparatus that includes a power circuit and a pixel is provided. The power circuit serves to provide a first voltage. The pixel includes a first transistor, a second transistor, a third transistor, a fourth transistor, a fifth transistor, a capacitor, and an OLED. A first terminal of the first transistor receives a data voltage, and a control terminal of the first transistor receives a scan signal. A first terminal of the capacitor is coupled to a second terminal of the first transistor. A first terminal of the second transistor receives the first voltage, and a control terminal of the second transistor is coupled to a second terminal of the capacitor. A first terminal of the third transistor is coupled to the control terminal of the second transistor, a control terminal of the third transistor receives the scan signal, and a second terminal of the third transistor is coupled to a second terminal of the second transistor. A first terminal of the fourth transistor is coupled to the second terminal of the second transistor, and a control terminal of the fourth transistor receives a light emitting signal. The OLED, the second transistor, and the fourth transistor are serially coupled between the first voltage and a second voltage. A first terminal of the fifth transistor receives an initial voltage, a control terminal of the fifth transistor receives the light emitting signal, and a second terminal of the fifth transistor is coupled to the first terminal of the capacitor. During a programming period, the scan signal is enabled, and the light emitting signal is disabled. Besides, the power circuit regulates a voltage level or a current of the first voltage to accelerate a voltage level of the control terminal of the second transistor to reach a target voltage.

According to an embodiment of the invention, a regulating period of the first voltage is shorter than the programming period.

According to an embodiment of the invention, when the first, second, third, fourth, and fifth transistors are p-type transistors, the first voltage is a system high voltage, and the second voltage is a ground voltage.

According to an embodiment of the invention, the target voltage is obtained by subtracting a threshold voltage of the second transistor from the system high voltage.

According to an embodiment of the invention, the power circuit includes a first power supply unit and a first multiplexer. The first power supply unit serves to provide a first reference voltage and a second reference voltage, and the second reference voltage is higher than the first reference voltage. The first multiplexer is coupled to the first power supply unit to receive the first reference voltage and the second reference voltage and receive a regulating signal. When the regulating signal is enabled, the first multiplexer outputs the second reference voltage as the system high voltage according to the enabled regulating signal; when the regulating signal is disabled, the first multiplexer outputs the first reference voltage as the system high voltage according to the disabled regulating signal.

According to an embodiment of the invention, the regulating signal is enabled during a regulating period of the system high voltage.

According to an embodiment of the invention, the first multiplexer includes a sixth transistor and a seventh transistor. A first terminal of the sixth transistor receives the first reference voltage, a control terminal of the sixth transistor receives the regulating signal, and a second terminal of the sixth transistor is coupled to the first terminal of the second transistor. A first terminal of the seventh transistor receives the second reference voltage, a control terminal of the seventh transistor receives the regulating signal, and a second terminal of the seventh transistor is coupled to the first terminal of the second transistor. Here, the sixth transistor and the seventh transistor are a p-type transistor and an n-type transistor, respectively.

According to an embodiment of the invention, when the first, second, third, fourth, and fifth transistors are n-type transistors, the first voltage is a system low voltage, and the second voltage is a system high voltage.

According to an embodiment of the invention, the target voltage is obtained by adding a threshold voltage of the second transistor and the system low voltage together.

According to an embodiment of the invention, the power circuit includes a second power supply unit and a second multiplexer. The second power supply unit serves to provide a third reference voltage and a fourth reference voltage, and the fourth reference voltage is lower than the third reference voltage. The second multiplexer is coupled to the second power supply unit to receive the third reference voltage and the fourth reference voltage and receive a regulating signal. When the regulating signal is enabled, the second multiplexer outputs the fourth reference voltage as the system low voltage according to the enabled regulating signal; when the regulating signal is disabled, the second multiplexer outputs the third reference voltage as the system low voltage according to the disabled regulating signal.

According to an embodiment of the invention, the regulating signal is enabled during a regulating period of the system low voltage.

According to an embodiment of the invention, the second multiplexer includes an eighth transistor and a ninth transistor. A first terminal of the eighth transistor receives the third reference voltage, a control terminal of the eighth transistor receives the regulating signal, and a second terminal of the eighth transistor is coupled to the first terminal of the second transistor. A first terminal of the ninth transistor receives the fourth reference voltage, a control terminal of the ninth transistor receives the regulating signal, and a second terminal of the ninth transistor is coupled to the first terminal of the second transistor. Here, the eighth transistor and the ninth transistor are a p-type transistor and an n-type transistor, respectively.

According to an embodiment of the invention, the power circuit includes a third power supply unit and a third multiplexer. The third power supply unit serves to provide the first voltage and a reference current, and the reference current is a fixed current. The third multiplexer is coupled to the third power supply unit to receive the first voltage and the reference current and receive a regulating signal. When the regulating signal is enabled, the third multiplexer outputs the reference current to the first terminal of the second transistor according to the enabled regulating signal; when the regulating signal is disabled, the third multiplexer outputs the first voltage to the first terminal of the second transistor according to the disabled regulating signal.

According to an embodiment of the invention, the regulating signal is enabled during a regulating period of the first voltage.

According to an embodiment of the invention, the third multiplexer includes a tenth transistor and an eleventh transistor. A first terminal of the tenth transistor receives the first voltage, a control terminal of the tenth transistor receives the regulating signal, and a second terminal of the tenth transistor is coupled to the first terminal of the second transistor. A first terminal of the eleventh transistor receives the reference current, a control terminal of the eleventh transistor receives the regulating signal, and a second terminal of the eleventh transistor is coupled to the first terminal of the second transistor. Here, the tenth transistor and the eleventh transistor are a p-type transistor and an n-type transistor, respectively.

According to an embodiment of the invention, the scan signal is disabled and the light emitting signal is enabled during a light emitting period.

According to an embodiment of the invention, the OLED display apparatus further includes a data driver for providing the data voltage.

According to an embodiment of the invention, the OLED display apparatus further includes a scan driver for providing the scan signal and the light emitting signal.

As described above, in the OLED display apparatus described in an embodiment of the invention, the voltage level or the current of the first voltage is regulated during the programming period, so as to accelerate the voltage level of the control terminal of the second transistor to reach the target voltage. Thereby, the sampling error rate of each pixel may be reduced, and the display quality of the OLED display apparatus may accordingly be improved. Here, the sampling error rate refers to a difference between an actual voltage level and a projected voltage level of the gate of the second transistor during the light emitting period.

Several exemplary embodiments accompanied with figures are described in detail below to further describe the invention in details.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DETAILED DESCRIPTION OF DISCLOSED EMBODIMENTS

Figure 1:
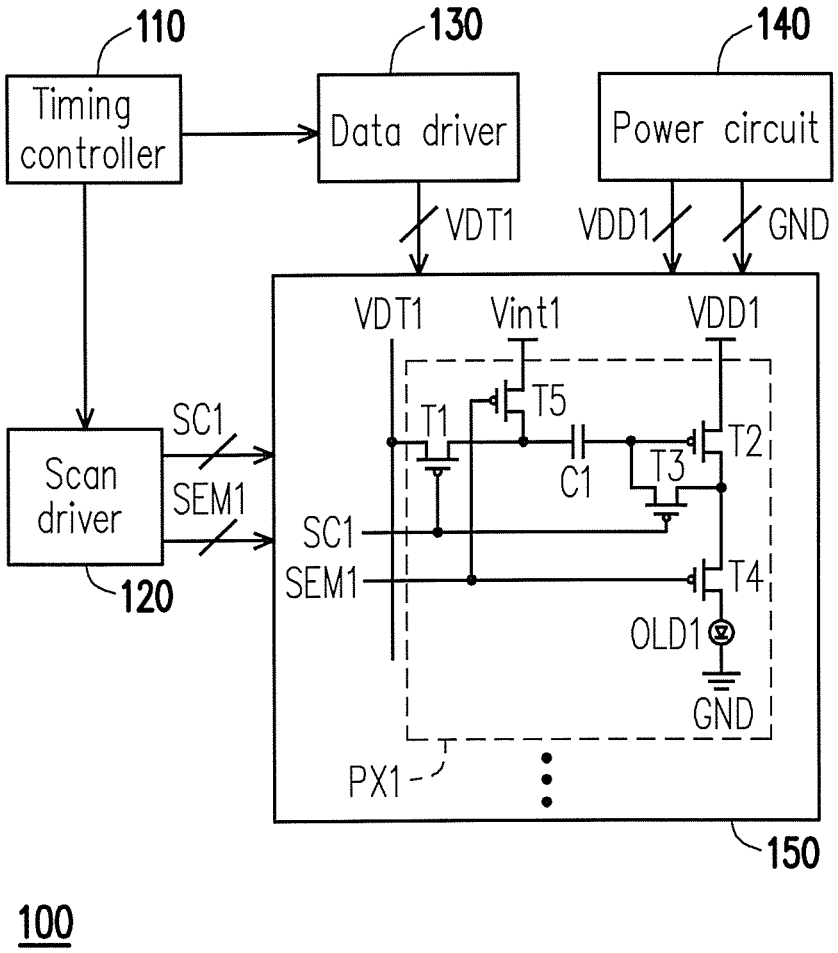
FIG. 1 is a systematic diagram schematically illustrating an organic light emitting diode (OLED) display apparatus according to a first embodiment of the invention.

FIG. 1 is a systematic diagram schematically illustrating an organic light emitting diode (OLED) display apparatus according to a first embodiment of the invention. With reference to FIG. 1, in the present embodiment, the OLED display apparatus 100 includes a timing controller 110, a scan driver 120, a data driver 130, a power circuit 140, and a display panel 150. The scan driver 120 is coupled to the timing controller 110 and the display panel 150. Besides, the scan driver 120 is controlled by the timing controller 110 to provide a plurality of scan signals SC1 and a plurality of light emitting signals SEM1 to the display panel 150. The data driver 130 is coupled to the timing controller 110 and the display panel 150. Besides, the data driver 130 is controlled by the timing controller 110 to provide a plurality of data voltages VDT1 to the display panel 150.

The power circuit 140 is coupled to the display panel 150 and provides a system high voltage VDD1 (corresponding to the first voltage) and a ground voltage GND (corresponding to the second voltage) to the display panel 150. The display panel 150 has a plurality of pixels PX1, and each pixel PX1 receives the system high voltage VDD1, the ground voltage GND, a corresponding data voltage VDT1, a corresponding scan signal SC1, and a corresponding light emitting signal SEM1.

Each pixel PX1 includes a plurality of transistors T1 to T5 (respectively corresponding to the first transistor to the fifth transistor), a capacitor C1, and an OLED OLD1. Here, the transistors T1 to T5 are all p-type transistors. The source (corresponding to the first terminal) of the transistor T1 receives the corresponding data voltage VDT1, and the gate (corresponding to the control terminal) of the transistor T1 receives the corresponding scan signal SC1. A first terminal of the capacitor C1 is coupled to the drain (corresponding to the second terminal) of the transistor T1. The source (corresponding to the first terminal) of the transistor T2 receives the system high voltage VDD1, and the gate (corresponding to the control terminal) of the transistor T2 is coupled to a second terminal of the capacitor C1. The source (corresponding to the first terminal) of the transistor T3 is coupled to the gate of the transistor T2, the gate (corresponding to the control terminal) of the transistor T3 receives the corresponding scan signal SC1, and the drain (corresponding to the second terminal) of the transistor T3 is coupled to the drain (corresponding to the second terminal) of the transistor T2. The source (corresponding to the first terminal) of the transistor T4 is coupled to the drain of the transistor T2, and the gate (corresponding to the control terminal) of the transistor T4 receives the corresponding light emitting signal SEM1. The anode of the OLED OLD1 is coupled to the drain of the transistor T4, and the cathode of the OLED OLD1 is coupled to the ground voltage GND. The source (corresponding to the first terminal) of the transistor T5 receives an initial voltage Vint1, the gate (corresponding to the control terminal) of the transistor T5 receives the corresponding light emitting signal SEM1, and the drain (corresponding to the second terminal) of the transistor T5 is coupled to the first terminal of the capacitor C1.

In the present embodiment, the OLED OLD1 is forward-coupled between the drain of the transistor T4 and the ground voltage GND; however, in another embodiment, the OLED OLD1 may be forward-coupled between the system high voltage VDD1 and the source of the transistor T2. That is, the OLED OLD1 and the transistors T2 and T4 are serially coupled between the system high voltage VDD1 and the ground voltage GND.

Figure 2A:
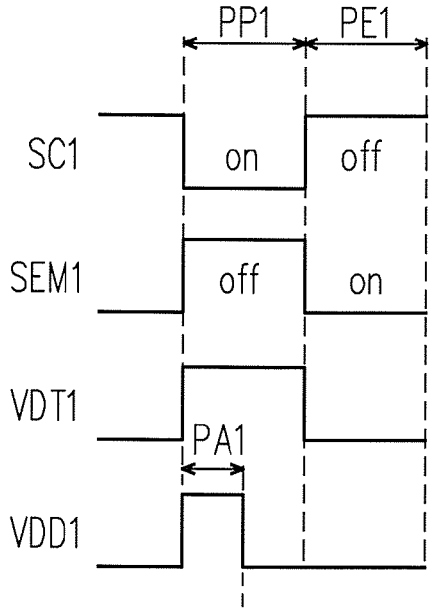
FIG. 2A is a schematic diagram illustrating a driving waveform of the OLED display apparatus depicted in FIG. 1 according to the first embodiment of the invention.
Figure 2B:
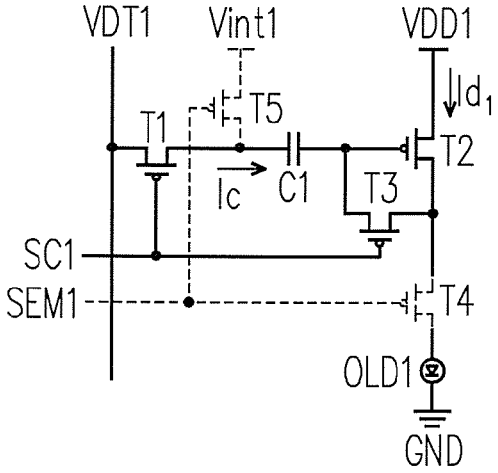
FIG. 2B is a schematic equivalent circuit diagram illustrating the pixel in the OLED display apparatus depicted in FIG. 2A during a programming period.

FIG. 2A is a schematic diagram illustrating a driving waveform of the OLED display apparatus depicted in FIG. 1 according to the first embodiment of the invention. FIG. 2B is a schematic equivalent circuit diagram illustrating the pixel in the OLED display apparatus depicted in FIG. 2A during a programming period. Here, one single pixel PX1 is exemplarily shown in FIG. 1, FIG. 2A, and FIG. 2B, and the voltage level of each light emitting signal SEM1 is set to be opposite to the voltage level of the corresponding scan signal SC1. During the programming period PP1, the scan driver 120 enables the corresponding scan signal SC1 and disables the corresponding light emitting signal SEM1, and the data driver 130 sets the voltage level of the corresponding data voltage VDT1. Here, the voltage level for enabling the scan signal SC1 is a low voltage level, and the voltage level for disabling the light emitting signal SEM1 is a high voltage level, for instance. At this time, the transistors T1 and T3 are controlled by the corresponding scan signal SC1 and are then turned on, while the transistors T4 and T5 are controlled by the corresponding light emitting signal SEM1 and are then turned off. The voltage level of the gate of the transistor T2 is lower than the system high voltage VDD1, a voltage difference between the voltage level of the gate of the transistor T2 and the system high voltage VDD1 is greater than a threshold voltage of the transistor T2, and thus the transistor T2 is turned on. Besides, the voltage level of the gate of the transistor T2 is raised because the current Id1 transmitted by the turned-on transistors T2 and T3 performs the charging function. Even though the conducting state of the transistor T2 is changed, the voltage difference between the voltage level of the gate of the transistor T2 and the system high voltage VDD1 is greater than or equal to the threshold voltage of the transistor T2.

During the light emitting period PE1, the scan driver 120 disables the corresponding scan signal SC1 and enables the corresponding light emitting signal SEM1, and the data driver 130 re-sets the voltage level of the corresponding data voltage VDT1. Here, the voltage level for disabling the scan signal SC1 is a high voltage level, and the voltage level for enabling the light emitting signal SEM1 is a low voltage level, for instance. At this time, the transistors T1 and T3 are controlled by the corresponding scan signal SC1 and are then turned off, while the transistors T4 and T5 are controlled by the corresponding light emitting signal SEM1 and are then turned on. The conducting state of the transistor T2 corresponds to the voltage level of the gate of the transistor T2, and the voltage level of the gate of the transistor T2 is determined by the initial voltage Vint1 and the voltage across the capacitor C1.

As shown in FIG. 2B, during the programming period PP1, the current Ic flowing through the capacitor C1 is equal to the current Id1 flowing through the transistor T2. Besides, the current Id1 is subject to the voltage level of the gate of the transistor T2, and the above-mentioned relations may be represented by following formulae.

$$Id1(t) = -Ic(t) = -C\frac{d(VG(t) - VDT)}{dt} = -C\frac{dVG(t)}{dt}$$

$$k0(VDD - VG(t) - |Vth|)^2 = -C\frac{dVG(t)}{dt}$$

$$VG(t) = VDD - |Vth| - \frac{1}{\frac{k_0 t}{Cs} + \sqrt{\frac{k_0}{I_0}}}$$

Here, Id1(t) denotes the transient current value of the current Id1, Ic(t) denotes the transient current value of the current Ic, VG(t) refers to the transient voltage level of the gate of the transistor T2, C refers to the capacitance of the capacitor C1, VDT refers to the voltage value of the data voltage VDT1, $k_0$ refers to the coefficient of current of the transistor T2, the voltage level VDD refers to the voltage value of the system high voltage VDD1, Vth refers to the threshold voltage of the transistor T2, $I_0$ refers to the initial current, and Cs refers to a constant.

In view of the above, given t=∞, the voltage level of the gate of the transistor T2 is equal to VDD−|Vth| (corresponding to the target voltage obtained by subtracting the threshold voltage Vth of the second transistor T2 from the system high voltage VDD1). However, the higher the voltage level of the gate of the transistor T2, the lower the hole mobility and the electron mobility of the transistor T2. Therefore, within a limited period of time, the voltage level of the gate of the transistor T2 is unable to reach VDD−|Vth|.

According to the present embodiment, to accelerate the voltage level of the gate of the transistor T2 to reach the target voltage obtained by subtracting the threshold voltage Vth of the second transistor T2 from the system high voltage VDD1, the power circuit 140 may be controlled to raise the voltage level of the system high voltage VDD1 during a regulating period PA1. Here, the regulating period PA1 is set as half the programming period PP1, which should not be construed as a limitation to the invention. However, note that the regulating period PA1 is shorter than the programming period PP1.

Figure 2C:
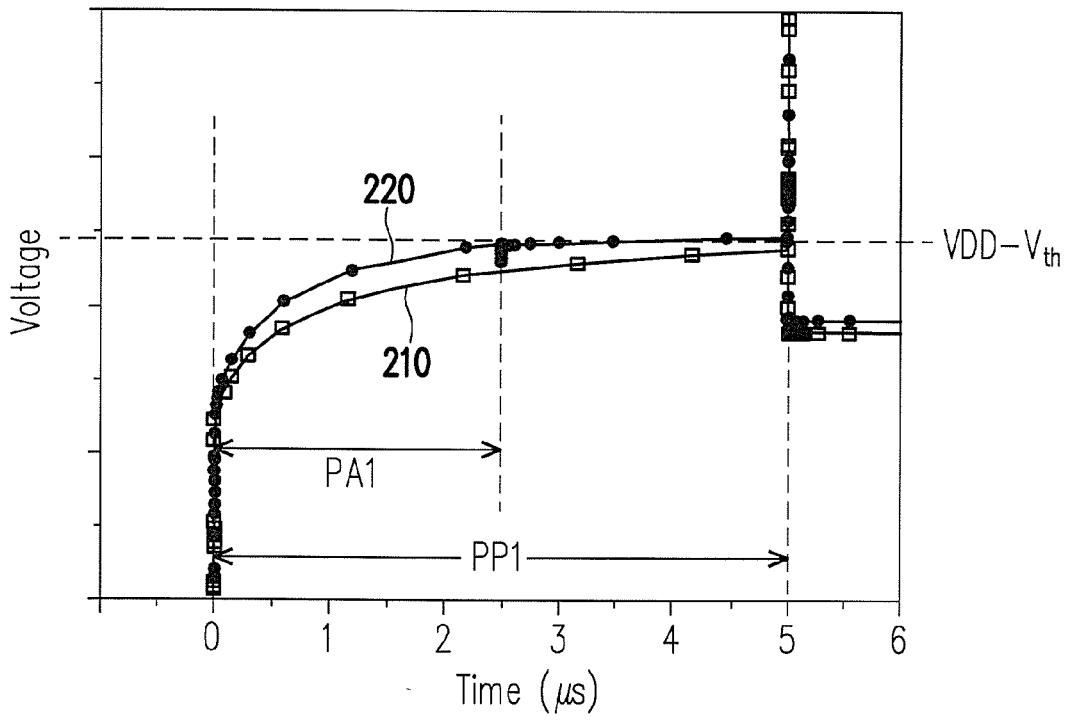
FIG. 2C is a schematic diagram illustrating contrast curves of gate voltages of a transistor when the system high voltage depicted in FIG. 2B is raised and is not raised.

FIG. 2C is a schematic diagram illustrating contrast curves of gate voltages of a transistor when the system high voltage depicted in FIG. 2B is raised and is not raised. With reference to FIG. 2A and FIG. 2C, the curve 210 shows that the system high voltage VDD is not raised, while the curve 220 shows that the system high voltage VDD is raised. In addition, the programming period PP1 is 5 microseconds, for instance. After the voltage level of the system high voltage VDD1 is raised, the voltage level of the gate of the transistor T2 is raised towards to the voltage level obtained by subtracting the threshold voltage Vth of the transistor T2 from the raised voltage level of the system high voltage VDD1. Thereby, the voltage level of the gate of the transistor T2 may be accelerated to reach the target voltage obtained by subtracting the threshold voltage Vth of the second transistor T2 from the system high voltage VDD1, and the sampling error rate of each pixel PX1 may be further lowered down. Here, the sampling error rate refers to a difference between an actual voltage level and a projected voltage level of the gate of the transistor T2 during the light emitting period PE1.

Figure 3:
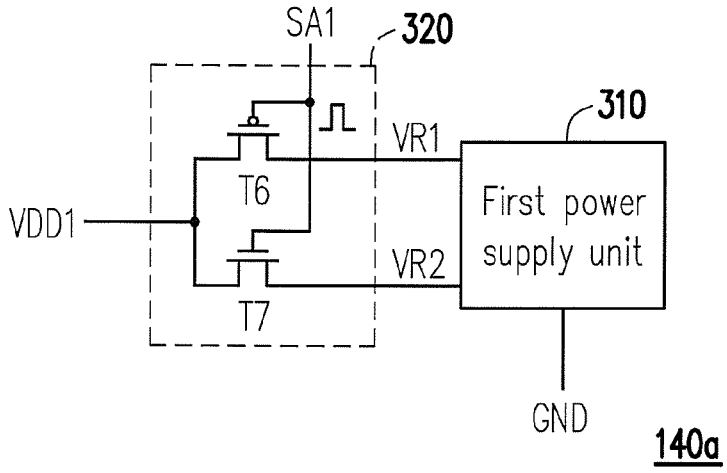
FIG. 3 is a schematic diagram illustrating the power circuit in the OLED display apparatus depicted in FIG. 1 according to the first embodiment of the invention.

FIG. 3 is a schematic diagram illustrating the power circuit in the OLED display apparatus depicted in FIG. 1 according to the first embodiment of the invention. With reference to FIG. 1 and FIG. 3, in the present embodiment, the power circuit 140*a* includes a first power supply unit 310 and a first multiplexer 320. The first power supply unit 310 provides a first reference voltage VR1, a second reference voltage VR2, and the ground voltage GND, and the second reference voltage VR2 is higher than the first reference voltage VR1. The first multiplexer 320 is coupled to the first power supply unit 310 to receive the first reference voltage VR1, the second reference voltage VR2, and a regulating signal SA1. When the regulating signal SA1 is enabled during the regulating period (e.g., the period PA1 shown in FIG. 2A) of the system high voltage VDD1, the first multiplexer 320 outputs the second reference voltage VR2 as the system high voltage VDD1 according to the enabled regulating signal SA1; by contrast, when the regulating signal SA1 is disabled, the first multiplexer 320 outputs the first reference voltage VR1 as the system high voltage VDD1 according to the disabled regulating signal SA1. Here, the voltage level for enabling the regulating signal SA1 is a high voltage level, and the voltage level for disabling the regulating signal SA1 is a low voltage level, for instance. The regulating signal SA1 may be generated by a control circuit, e.g., the timing controller 110, which should however not be construed as a limitation to the invention.

To be specific, in the present embodiment, the first multiplexer 320 includes transistors T6 and T7 (corresponding to the sixth transistor and the seventh transistor), the transistor T6 is a p-type transistor, and the transistor T7 is an n-type transistor. The source (corresponding to the first terminal) of the transistor T6 receives the first reference voltage VR1, the gate (corresponding to the control terminal) of the transistor T6 receives the regulating signal SA1, and the drain (corresponding to the second terminal) of the transistor T6 is coupled to the source of the transistor T2. The drain (corresponding to the first terminal) of the transistor T7 receives the second reference voltage VR2, the gate (corresponding to the control terminal) of the transistor T7 receives the regulating signal SA1, and the source (corresponding to the second terminal) of the transistor T7 is coupled to the source of the transistor T2.

When the regulating signal SA1 is enabled, the transistor T6 is turned off, and the transistor T7 is turned on; thereby, the second reference voltage VR2 may be output to the source of the transistor T2 as the system high voltage VDD1; when the regulating signal SA1 is disabled, the transistor T6 is turned on, and the transistor T7 is turned off; thereby, the first reference voltage VR1 may be output to the source of the transistor T2 as the system high voltage VDD1. Here, the voltage level for enabling the regulating signal SA1 is a high voltage level, and the voltage level for disabling the regulating signal SA1 is a low voltage level, for instance.

Figure 4:
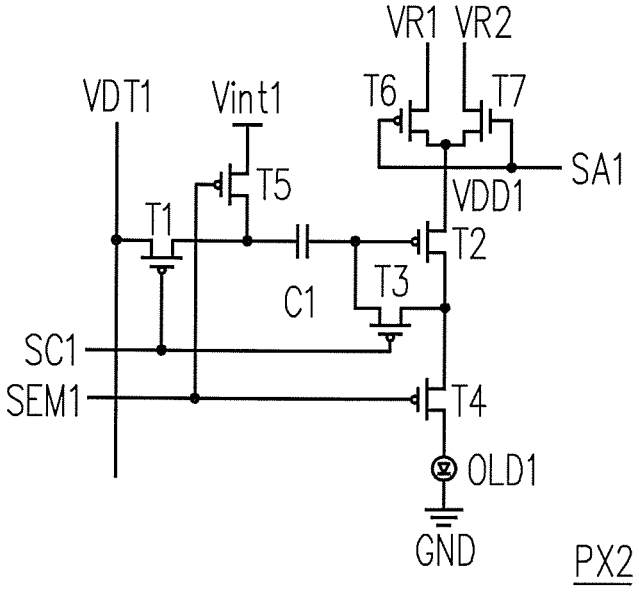
FIG. 4 is a schematic circuit diagram illustrating the pixel in the OLED display apparatus depicted in FIG. 1 according to a second embodiment of the invention.

FIG. 4 is a schematic circuit diagram illustrating the pixel in the OLED display apparatus depicted in FIG. 1 according to a second embodiment of the invention With reference to FIG. 1, FIG. 3, and FIG. 4, in the embodiment shown in FIG. 3, the multiplexer 320 is located in the power circuit 140*a*. In the present embodiment, the pixel PX2 is similar to the pixel PX1, while the difference therebetween lies in that the transistors T6 and T7 of the multiplexer 320 are disposed in the pixel PX2. Namely, the power circuit 140 may be merely equipped with the first power supply unit 310. The coupling relations of components in the present embodiment may be referred to as those described previously and thus will not be further elaborated.

Figure 5A:
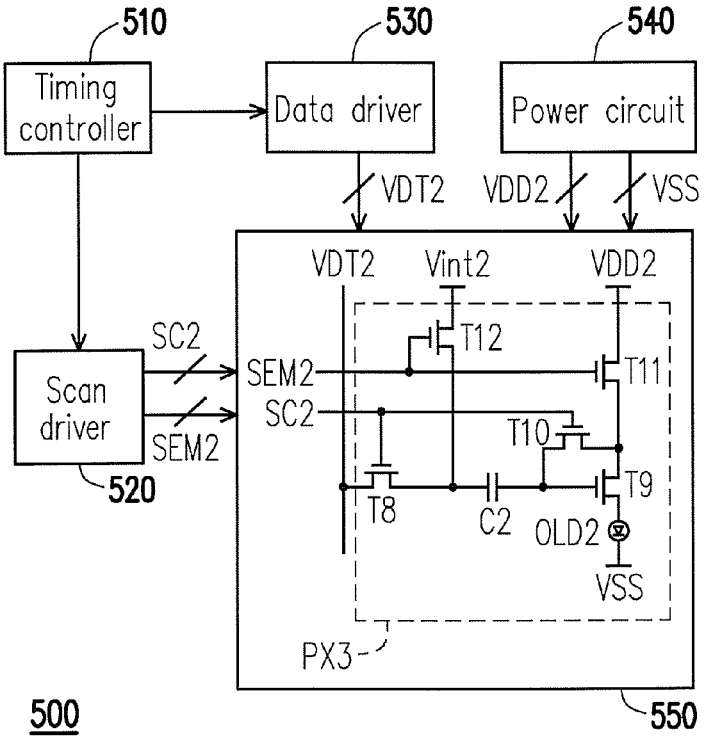
FIG. 5A is a systematic diagram schematically illustrating an OLED display apparatus according to a third embodiment of the invention.

FIG. 5A is a systematic diagram schematically illustrating an OLED display apparatus according to a third embodiment of the invention. With reference to FIG. 5A, in the present embodiment, the OLED display apparatus 500 includes a timing controller 510, a scan driver 520, a data driver 530, a power circuit 540, and a display panel 550. The scan driver 520 is coupled to the timing controller 510 and the display panel 550. Besides, the scan driver 520 is controlled by the timing controller 510 to provide a plurality of scan signals SC2 and a plurality of light emitting signals SEM2 to the display panel 550. The data driver 530 is coupled to the timing controller 510 and the display panel 550. Besides, the data driver 530 is controlled by the timing controller 510 to provide a plurality of data voltages VDT2 to the display panel 550.

The power circuit 540 is coupled to the display panel 550 and provides a system high voltage VDD2 (corresponding to the second voltage) and a system low voltage VSS (corresponding to the first voltage) to the display panel 550. The display panel 550 has a plurality of pixels PX3, and each pixel PX3 receives the system high voltage VDD2, the system low voltage VSS, a corresponding data voltage VDT2, a corresponding scan signal SC2, and a corresponding light emitting signal SEM2.

Each pixel PX3 includes a plurality of transistors T8 to T12 (respectively corresponding to the first transistor to the fifth transistor), a capacitor C2, and an OLED OLD2. Here, the transistors T8 to T12 are all n-type transistors. The drain (corresponding to the first terminal) of the transistor T8 receives the corresponding data voltage VDT2, and the gate (corresponding to the control terminal) of the transistor T8 receives the corresponding scan signal SC2. A first terminal of the capacitor C2 is coupled to the source (corresponding to the second terminal) of the transistor T8. The gate (corresponding to the control terminal) of the transistor T9 is coupled to a second terminal of the capacitor C2. The source (corresponding to the first terminal) of the transistor T10 is coupled to the gate of the transistor T9, the gate (corresponding to the control terminal) of the transistor T10 receives the corresponding scan signal SC2, and the drain (corresponding to the second terminal) of the transistor T10 is coupled to the drain (corresponding to the second terminal) of the transistor T9. The source (corresponding to the first terminal) of the transistor T11 is coupled to the drain (corresponding to the second terminal) of the transistor T9, the gate (corresponding to the control terminal) of the transistor T11 receives the corresponding light emitting signal SEM2, and the drain (corresponding to the second terminal) of the transistor T11 receives the system high voltage VDD2. The anode of the OLED OLD2 is coupled to the source (corresponding to the first terminal) of the transistor T9, and the cathode of the OLED OLD2 is coupled to the system low voltage VSS. The drain (corresponding to the first terminal) of the transistor T12 receives an initial voltage Vint2, the gate (corresponding to the control terminal) of the transistor T12 receives the corresponding light emitting signal SEM2, and the source (corresponding to the second terminal) of the transistor T12 is coupled to the first terminal of the capacitor C2. Here, the source of the transistor T9 receives the system low voltage VSS through the OLED OLD2.

In the present embodiment, the OLED OLD2 is forward-coupled between the source of the transistor T9 and the system low voltage VSS; however, in another embodiment, the OLED OLD2 may be forward-coupled between the system high voltage VDD2 and the drain of the transistor T11. That is, the OLED OLD2 and the transistors T9 and T11 are serially coupled between the system high voltage VDD2 and the system low voltage VSS.

Figure 5B:
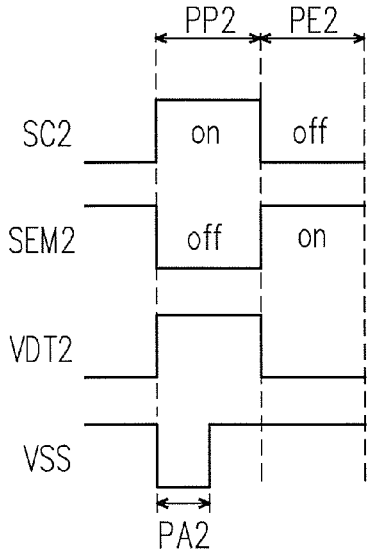
FIG. 5B is a schematic diagram illustrating a driving waveform of the OLED display apparatus depicted in FIG. 5A according to the third embodiment of the invention.

FIG. 5B is a schematic diagram illustrating a driving waveform of the OLED display apparatus depicted in FIG. 5A according to the third embodiment of the invention. Here, one single pixel PX3 is exemplarily shown in FIG. 5B, and the voltage level of each light emitting signal SEM2 is set to be opposite to the voltage level of the corresponding scan signal SC2. During the programming period PP2, the scan driver 520 enables the corresponding scan signal SC2 and disables the corresponding light emitting signal SEM2, and the data driver 530 sets the voltage level of the corresponding data voltage VDT2. Here, the voltage level for enabling the scan signal SC2 is a high voltage level, and the voltage level for disabling the light emitting signal SEM2 is a low voltage level, for instance. At this time, the transistors T8 and T10 are controlled by the corresponding scan signal SC2 and are then turned on, while the transistors T11 and T12 are controlled by the corresponding light emitting signal SEM2 and are then turned off. The voltage level of the gate of the transistor T9 is higher than the system low voltage VSS, a voltage difference between the voltage level of the gate of the transistor T9 and the system low voltage VSS is greater than or equal to a threshold voltage of the transistor T9, and thus the transistor T9 is turned on. Besides, the voltage level of the gate of the transistor T9 is lowered down because the turned-on transistors T9 and T10 receive the system low voltage VSS and start to discharge. Even though the conducting state of the transistor T9 is changed, the voltage difference between the voltage level of the gate of the transistor T9 and the system low voltage VSS is greater than or equal to the threshold voltage of the transistor T9.

During the light emitting period PE2, the scan driver 520 disables the corresponding scan signal SC2 and enables the corresponding light emitting signal SEM2, and the data driver 530 re-sets the voltage level of the corresponding data voltage VDT2. Here, the voltage level for disabling the scan signal SC2 is a low voltage level, and the voltage level for enabling the light emitting signal SEM2 is a high voltage level, for instance. At this time, the transistors T8 and T10 are controlled by the corresponding scan signal SC2 and are then turned off, while the transistors T11 and T12 are controlled by the corresponding light emitting signal SEM2 and are then turned on. The conducting state of the transistor T9 corresponds to the voltage level of the gate of the transistor T9, and the voltage level of the gate of the transistor T9 is determined by the initial voltage Vint2 and the voltage across the capacitor C2.

According to the present embodiment, to accelerate the voltage level of the gate of the transistor T9 to reach the target voltage obtained by adding the threshold voltage Vth of the transistor T9 and the system low voltage VSS together, the power circuit 540 may be controlled to lower down the voltage level of the system low voltage VSS during a regulating period PA2. Here, the regulating period PA2 is set as half the programming period PP2, which should not be construed as a limitation to the invention. However, note that the regulating period PA2 is shorter than the programming period PP2.

Figure 6:
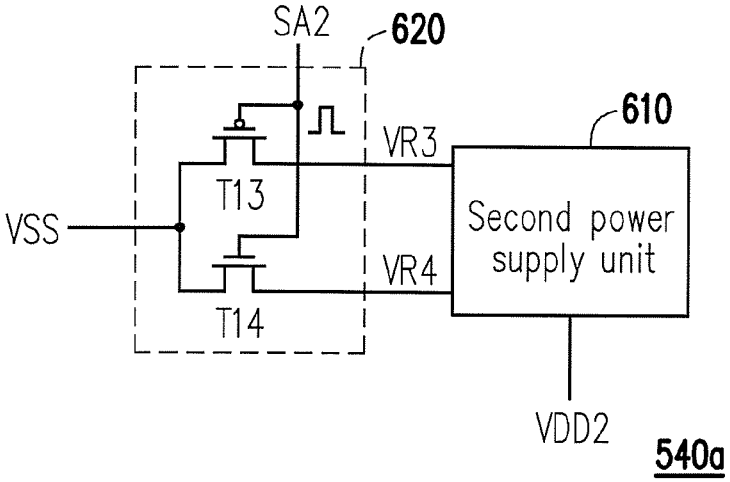
FIG. 6 is a schematic diagram illustrating the power circuit in the OLED display apparatus depicted in FIG. 5A according to the third embodiment of the invention.

FIG. 6 is a schematic diagram illustrating the power circuit in the OLED display apparatus depicted in FIG. 5A according to the third embodiment of the invention. With reference to FIG. 5A and FIG. 6, in the present embodiment, the power circuit 540*a* includes a second power supply unit 610 and a second multiplexer 620. The second power supply unit 610 provides a third reference voltage VR3, a fourth reference voltage VR4, and the system high voltage VDD2, and the fourth reference voltage VR4 is lower than the third reference voltage VR3. The second multiplexer 620 is coupled to the second power supply unit 610 to receive the third reference voltage VR3 and the fourth reference voltage VR4 and receive a regulating signal SA2. When the regulating signal SA2 is enabled during the regulating period (e.g., the period PA2 shown in FIG. 5B) of the system low voltage VSS, the second multiplexer 620 outputs the fourth reference voltage VR4 as the system low voltage VSS according to the enabled regulating signal SA2; by contrast, when the regulating signal SA2 is disabled, the second multiplexer 620 outputs the third reference voltage VR3 as the system low voltage VSS according to the disabled regulating signal SA2. Here, the voltage level for enabling the regulating signal SA2 is a high voltage level, and the voltage level for disabling the regulating signal SA2 is a low voltage level, for instance. The regulating signal SA2 may be generated by a control circuit, e.g., the timing controller 510, which should however not be construed as a limitation to the invention.

To be specific, in the present embodiment, the second multiplexer 620 includes transistors T13 and T14 (corresponding to the eighth transistor and the ninth transistor), the transistor T13 is a p-type transistor, and the transistor T14 is an n-type transistor. The source (corresponding to the first terminal) of the transistor T13 receives the third reference voltage VR3, the gate (corresponding to the control terminal) of the transistor T13 receives the regulating signal SA2, and the drain (corresponding to the second terminal) of the transistor T13 is coupled to the cathode of the OLED OLD2. The drain (corresponding to the first terminal) of the transistor T14 receives the fourth reference voltage VR4, the gate (corresponding to the control terminal) of the transistor T14 receives the regulating signal SA2, and the source (corresponding to the second terminal) of the transistor T14 is coupled to the cathode of the OLED OLD2.

When the regulating signal SA2 is enabled, the transistor T13 is turned off, and the transistor T14 is turned on; thereby, the fourth reference voltage VR4 may be output to the cathode of the OLED OLD2 as the system low voltage VSS; when the regulating signal SA2 is disabled, the transistor T13 is turned on, and the transistor T14 is turned off; thereby, the third reference voltage VR3 may be output to the cathode of the OLED OLD2 as the system low voltage VSS. Here, the voltage level for enabling the regulating signal SA2 is a high voltage level, and the voltage level for disabling the regulating signal SA2 is a low voltage level, for instance.

Figure 7:
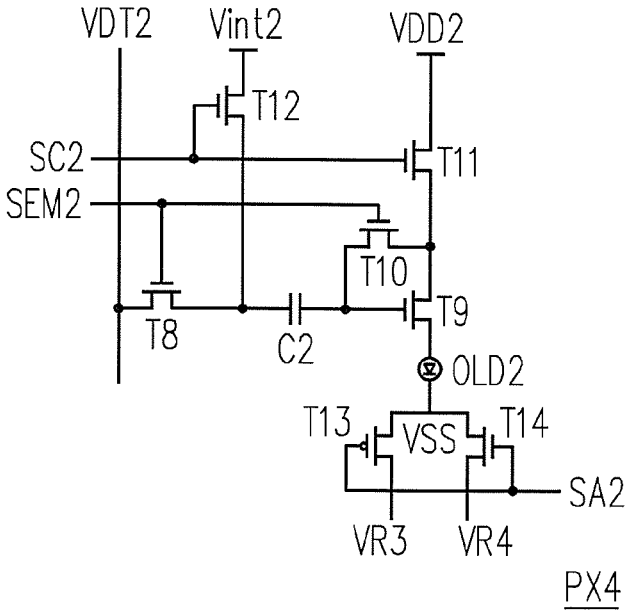
FIG. 7 is a schematic circuit diagram illustrating the pixel in the OLED display apparatus depicted in FIG. 5A according to a fourth embodiment of the invention.

FIG. 7 is a schematic circuit diagram illustrating the pixel in the OLED display apparatus depicted in FIG. 5A according to a fourth embodiment of the invention. With reference to FIG. 5A, FIG. 6, and FIG. 7, in the embodiment shown in FIG. 6, the multiplexer 620 is located in the power circuit 540*a*. In the present embodiment, the pixel PX4 is similar to the pixel PX3, while the difference therebetween lies in that the transistors T13 and T14 of the multiplexer 620 are disposed in the pixel PX4. Namely, the power circuit 540 may be merely equipped with the second power supply unit 610. The coupling relations of components in the present embodiment may be referred to as those described previously and thus will not be further elaborated.

In the previous embodiments, the voltage level of the gate of the transistor coupled to the OLED is accelerated to reach the target voltage by regulating the voltage; nonetheless, in other embodiments, the current flowing through the transistor coupled to the OLED may also be regulated to achieve the same effect.

Figure 8:
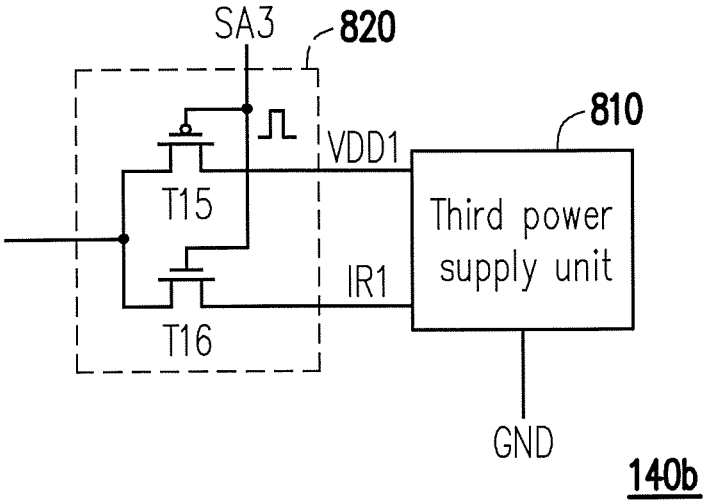
FIG. 8 is a schematic diagram illustrating the power circuit in the OLED display apparatus depicted in FIG. 1 according to the first embodiment of the invention.

FIG. 8 is a schematic diagram illustrating the power circuit in the OLED display apparatus depicted in FIG. 1 according to the first embodiment of the invention. With reference to FIG. 1 and FIG. 8, in the present embodiment, the power circuit 140*b* includes a third power supply unit 810 and a third multiplexer 820. The third power supply unit 810 provides the system high voltage VDD1, a reference current IR1, and the ground voltage GND. Here, the reference current IR1 is a fixed current and may be generated by a current mirror or the like. The third multiplexer 820 is coupled to the third power supply unit 810 to receive the system high voltage VDD1 and the reference current IR1 and receive a regulating signal SA3. When the regulating signal SA3 is enabled during the regulating period (e.g., the period PA1 shown in FIG. 2A) of the system high voltage VDD1, the third multiplexer 820 outputs the reference current IR1 according to the enabled regulating signal SA3; by contrast, when the regulating signal SA3 is disabled, the third multiplexer 820 outputs the system high voltage VDD1 according to the disabled regulating signal SA3. Here, the voltage level for enabling the regulating signal SA3 is a high voltage level, and the voltage level for disabling the regulating signal SA3 is a low voltage level, for instance. The regulating signal SA3 may be generated by a control circuit, e.g., the timing controller 110, which should however not be construed as a limitation to the invention.

To be specific, in the present embodiment, the third multiplexer 820 includes transistors T15 and T16 (corresponding to the tenth transistor and the eleventh transistor), the transistor T15 is a p-type transistor, and the transistor T16 is an n-type transistor. The source (corresponding to the first terminal) of the transistor T15 receives the system high voltage VDD1, the gate (corresponding to the control terminal) of the transistor T15 receives the regulating signal SA3, and the drain (corresponding to the second terminal) of the transistor T15 is coupled to the source of the transistor T2. The drain (corresponding to the first terminal) of the transistor T16 receives the reference current IR1, the gate (corresponding to the control terminal) of the transistor T16 receives the regulating signal SA3, and the source (corresponding to the second terminal) of the transistor T16 is coupled to the source of the transistor T2.

When the regulating signal SA3 is enabled, the transistor T15 is turned off, and the transistor T16 is turned on; thereby, the reference current IR1 may be output to the source of the transistor T2; when the regulating signal SA3 is disabled, the transistor T15 is turned on, and the transistor T16 is turned off; thereby, the system high voltage VDD1 may be output to the source of the transistor T2. Here, the voltage level for enabling the regulating signal SA3 is a high voltage level, and the voltage level for disabling the regulating signal SA3 is a low voltage level, for instance.

Figure 9:
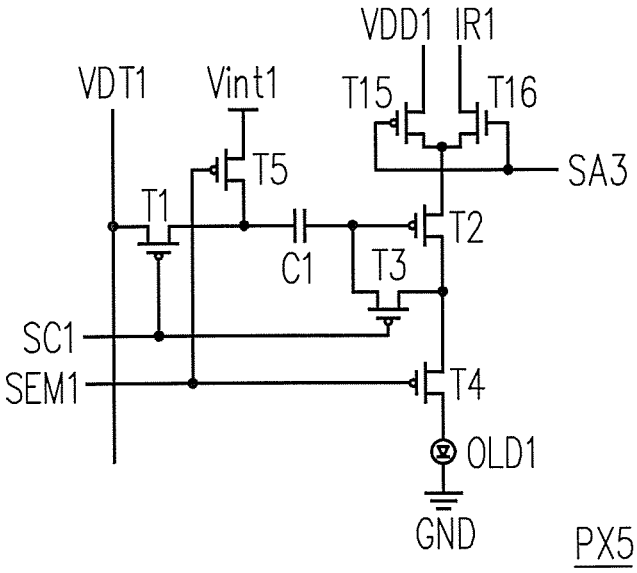
FIG. 9 is a schematic circuit diagram illustrating the pixel in the OLED display apparatus depicted in FIG. 1 according to a fifth embodiment of the invention.

FIG. 9 is a schematic circuit diagram illustrating the pixel in the OLED display apparatus depicted in FIG. 1 according to a fifth embodiment of the invention. With reference to FIG. 1, FIG. 8, and FIG. 9, in the embodiment shown in FIG. 8, the multiplexer 820 is located in the power circuit 140*b*. In the present embodiment, the pixel PX5 is similar to the pixel PX1, while the difference therebetween lies in that the transistors T15 and T16 of the multiplexer 820 are disposed in the pixel PX5. Namely, the power circuit 140 may be merely equipped with the third power supply unit 810. The coupling relations of components in the present embodiment may be referred to as those described previously and thus will not be further elaborated.

To sum up, in the OLED display apparatus described in an embodiment of the invention, the voltage level or the current of the system high voltage or the system low voltage is regulated during the programming period, so as to accelerate the voltage level of the gate of the transistor coupled to the OLED to reach the target voltage. Thereby, the sampling error rate of each pixel may be reduced, and the display quality of the OLED display apparatus may accordingly be improved. Here, the sampling error rate refers to a difference between an actual voltage level and a projected voltage level of the gate of the transistor coupled to the OLED during the light emitting period.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. An organic light emitting diode display apparatus comprising:

a power circuit for providing a first voltage; and a pixel comprising:

a first transistor, a first terminal of the first transistor receiving a data voltage, a control terminal of the first transistor receiving a scan signal;

a capacitor, a first terminal of the capacitor being coupled to a second terminal of the first transistor;

a second transistor, a first terminal of the second transistor receiving the first voltage, a control terminal of the second transistor being coupled to a second terminal of the capacitor;

a third transistor, a first terminal of the third transistor being coupled to the control terminal of the second transistor, a control terminal of the third transistor receiving the scan signal, a second terminal of the third transistor being coupled to a second terminal of the second transistor;

a fourth transistor, a first terminal of the fourth transistor being coupled to the second terminal of the second transistor, a control terminal of the fourth transistor receiving a light emitting signal, wherein a waveform of the light emitting signal is inverted to a waveform of the scan signal;

an organic light emitting diode, the organic light emitting diode, the second transistor, and the fourth transistor being serially coupled between the first voltage and a second voltage; and a fifth transistor, a first terminal of the fifth transistor receiving an initial voltage, a control terminal of the fifth transistor receiving the light emitting signal, a second terminal of the fifth transistor being coupled to the first terminal of the capacitor, wherein during a programming period, the scan signal is enabled throughout the programming period, the light emitting signal is disabled throughout the programming period, the data voltage is set throughout the programming period, and the power circuit regulates a voltage level of the first voltage to be lower than an original voltage level of the first voltage during a regulating period that is shorter than the programming period, so as to accelerate a voltage level of the control terminal of the second transistor to reach a target voltage, and during a light emitting period subsequent to the programming period, the scan signal is disabled throughout the light emitting period, the light emitting signal is enabled throughout the light emitting period, the data voltage is re-set throughout the light emitting period, and the power circuit regulates the voltage level of the first voltage to be the original voltage level.

2. The organic light emitting diode display apparatus as recited in claim 1, wherein when the first, second, third, fourth, and fifth transistors are n-type transistors, the first voltage is a system low voltage, and the second voltage is a system high voltage.

3. The organic light emitting diode display apparatus as recited in claim 2, wherein the target voltage is obtained by adding a threshold voltage of the second transistor and the system low voltage together.

4. The organic light emitting diode display apparatus as recited in claim 2, wherein the power circuit comprises:

a first power supply unit for providing a first reference voltage and a second reference voltage, the second reference voltage being lower than the first reference voltage; and a first multiplexer coupled to the first power supply unit to receive the first reference voltage and the second reference voltage and receive a regulating signal, wherein when the regulating signal is enabled, the first multiplexer outputs the second reference voltage as the system low voltage according to the enabled regulating signal, and when the regulating signal is disabled, the first multiplexer outputs the first reference voltage as the system low voltage according to the disabled regulating signal.

5. The organic light emitting diode display apparatus as recited in claim 4, wherein the regulating signal is enabled during a regulating period of the system low voltage.

6. The organic light emitting diode display apparatus as recited in claim 5, wherein the first multiplexer comprises:

an sixth transistor, a first terminal of the sixth transistor receiving the first reference voltage, a control terminal of the sixth transistor receiving the regulating signal, a second terminal of the sixth transistor being coupled to the first terminal of the second transistor; and a seventh transistor, a first terminal of the seventh transistor receiving the second reference voltage, a control terminal of the seventh transistor receiving the regulating signal, a second terminal of the seventh transistor being coupled to the first terminal of the second transistor, wherein the sixth transistor and the seventh transistor are a p-type transistor and an n-type transistor, respectively.

7. The organic light emitting diode display apparatus as recited in claim 1, further comprising a data driver for providing the data voltage.

8. The organic light emitting diode display apparatus as recited in claim 1, further comprising a scan driver for providing the scan signal and the light emitting signal.

* * * * *